US006206137B1

(12) United States Patent
Wolner et al.

(10) Patent No.: US 6,206,137 B1
(45) Date of Patent: Mar. 27, 2001

(54) CONNECTOR FOR A PERSONAL SAFETY DEVICE

(75) Inventors: James T. Wolner, Red Wing; Scott C. Casebolt, St. Paul Park, both of MN (US)

(73) Assignee: D B Industries, Inc., Red Wing, MN (US)

( * ) Notice: Subject to any disclaimer, the term of this patent is extended or adjusted under 35 U.S.C. 154(b) by 0 days.

(21) Appl. No.: 09/524,703

(22) Filed: Mar. 14, 2000

Related U.S. Application Data

(63) Continuation-in-part of application No. 09/177,403, filed on Oct. 23, 1998, now Pat. No. 6,073,724.

(51) Int. Cl.[7] ..... A47C 3/04
(52) U.S. Cl. ..... 182/3; 182/36
(58) Field of Search ..... 182/3, 36, 6

(56) References Cited

U.S. PATENT DOCUMENTS

| | | | |
|---|---|---|---|
| 4,140,205 | 2/1979 | Matson | 182/3 |
| 4,877,110 | 10/1989 | Wolner | 182/232 |
| 5,156,233 | 10/1992 | Olsen et al. | 182/3 |
| 5,351,906 | 10/1994 | Feathers | 242/396.6 |

*Primary Examiner*—Alvin Chin-Shue
(74) *Attorney, Agent, or Firm*—Mau & Krull, P.A.

(57) ABSTRACT

A connector includes a bolt and another structural member which cooperate to form a closed loop about portions of two otherwise separate articles. The bolt extends through at least one flange on a first article and through opposite ends of the other structural member to form a closed loop about the two articles. A radially extending flange is rigidly secured to an intermediate portion of the bolt and cooperates with a head at one end of the bolt to capture both the flange on the first article and a first end of the other structural member therebetween. A spring biases an opposite, second end of the bolt through a second end of the structural member and preferably through another flange on the first article, as well. A latching mechanism selectively prevents movement of the bolt in opposition to the force exerted by the spring, which must be overcome in order to release the second article from the first article. In one application, the connector is mounted on a personal safety device to effect a serial connection between a person and a support structure.

20 Claims, 6 Drawing Sheets

CONNECTOR FOR A PERSONAL SAFETY DEVICE

CROSS-REFERENCE TO RELATED APPLICATION

This application is a continuation-in-part of Ser. No. 09/177,403 now U.S. patent 6,073,724 for CONNECTOR FOR A PERSONAL SAFETY DEVICE, which issued on Jun. 13, 2000.

FIELD OF THE INVENTION

The present invention relates to methods and apparatus for interconnecting two articles in series with one another.

BACKGROUND OF THE INVENTION

Connectors are suitable for various purposes and in various applications. For example, fall-arresting safety devices require a reliable safety line and reliable connections to both the support structure and the person working in proximity to the support structure.

Typically, one or more deceleration devices is connected in series with the safety line. For example, U.S. Pat. No. 5,351,906 to Feathers discloses a safety anchorage device which controls pay-out of a safety line. This prior art anchorage device is selectively connected to a support structure, and the safety line is selectively connected to a person (via a body harness, for example). In the event of a fall, the safety line and the other parts of the anchorage device cooperate to safely bring the person to rest.

Another exemplary safety device is disclosed in U.S. Pat. No. 4,877,110 to Wolner. This prior art safety device similarly controls pay-out of a safety line during normal work activity and/or in the event of a fall. In this patent, however, the device is shown anchored to the body harness, and the safety line is shown connected to the support structure. An object of the present invention is to provide an improved connector suitable for use in various applications, including fall-arrest systems.

SUMMARY OF THE INVENTION

The present invention provides connection methods and apparatus suitable for various purposes, including connecting a personal safety device in series between a person and a support structure. On a first embodiment of the present invention, the distal end of a bolt is inserted though one end of a U-shaped member and through spaced apart tabs on a safety device. The distal end of the bolt is then selectively threaded through an opposite end of the U-shaped member. A stop is rigidly secured to an intermediate portion of the bolt to retain one of the tabs between the stop and the end of the U-shaped member nearer the bolt. A spring is disposed between the stop and the head of the bolt to bias the bolt toward the other tab (and the threaded end of the U-shaped member).

On a second embodiment of the present invention, the distal end of the bolt is simply inserted through the opposite end of the U-shaped member. The spring biases a lever toward an orientation which prevents withdrawal of the bolt from the opposite end of the U-shaped member. When the lever is moved out of the way, and the bolt is withdrawn from the opposite end of the U-shaped member, the lever may be released to hold the bolt in this open configuration.

The connectors of the present invention are convenient to use and reliable in use. They are suitable for use with various sorts of existing devices and are believed to be particularly well-suited for incorporation into safety devices. Additional features and/or advantages of the present invention may become more apparent from the detailed description which follows.

BRIEF DESCRIPTION OF THE DRAWING

With reference to the Figures, wherein like numerals represent like parts and assemblies throughout the several views.

DETAILED DESCRIPTION OF THE PREFERRED EMBODIMENT

Figure 1:
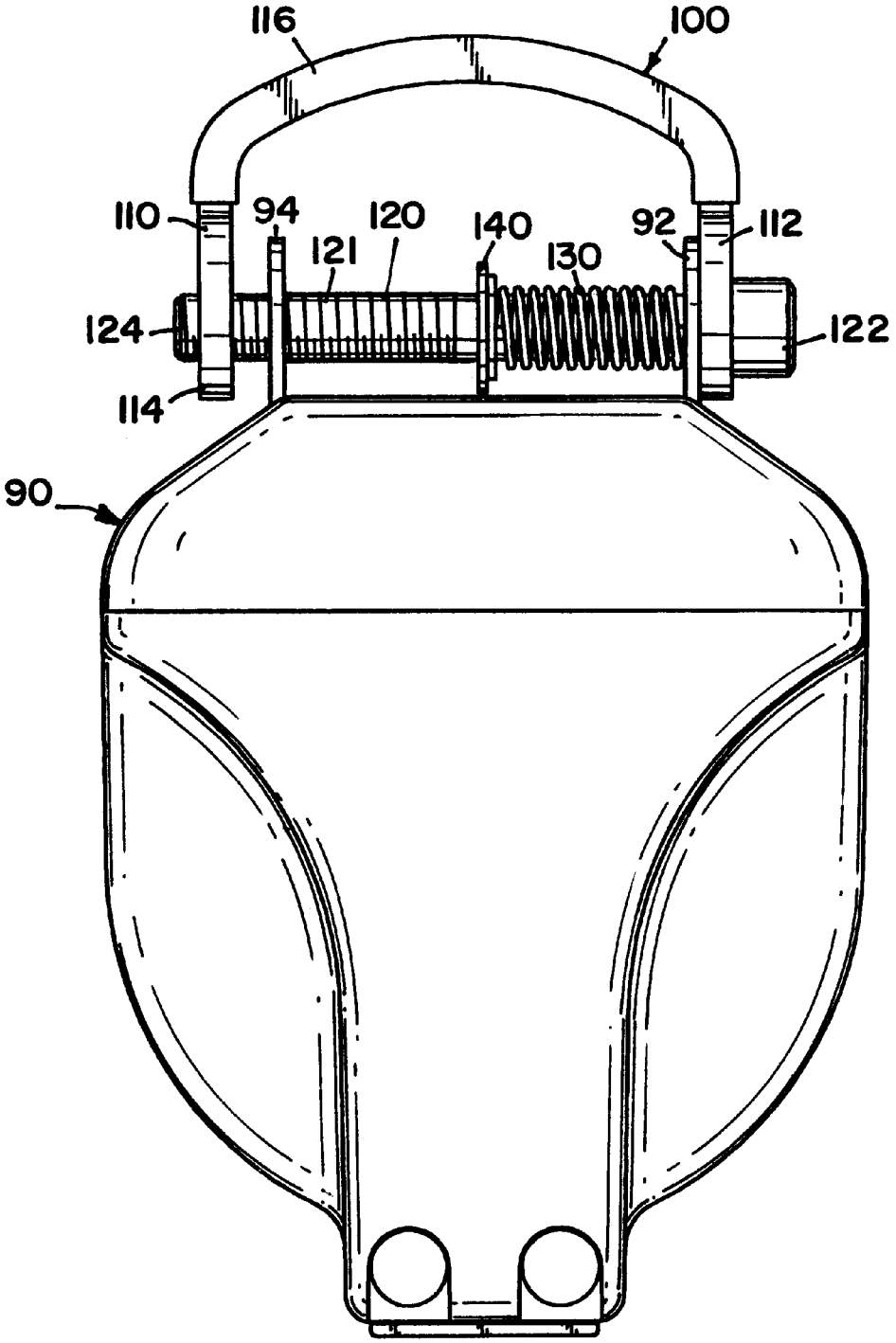
FIG. 1 is a front view of a personal safety apparatus provided with a first connector constructed according to the principles of the present invention.
Figure 2:
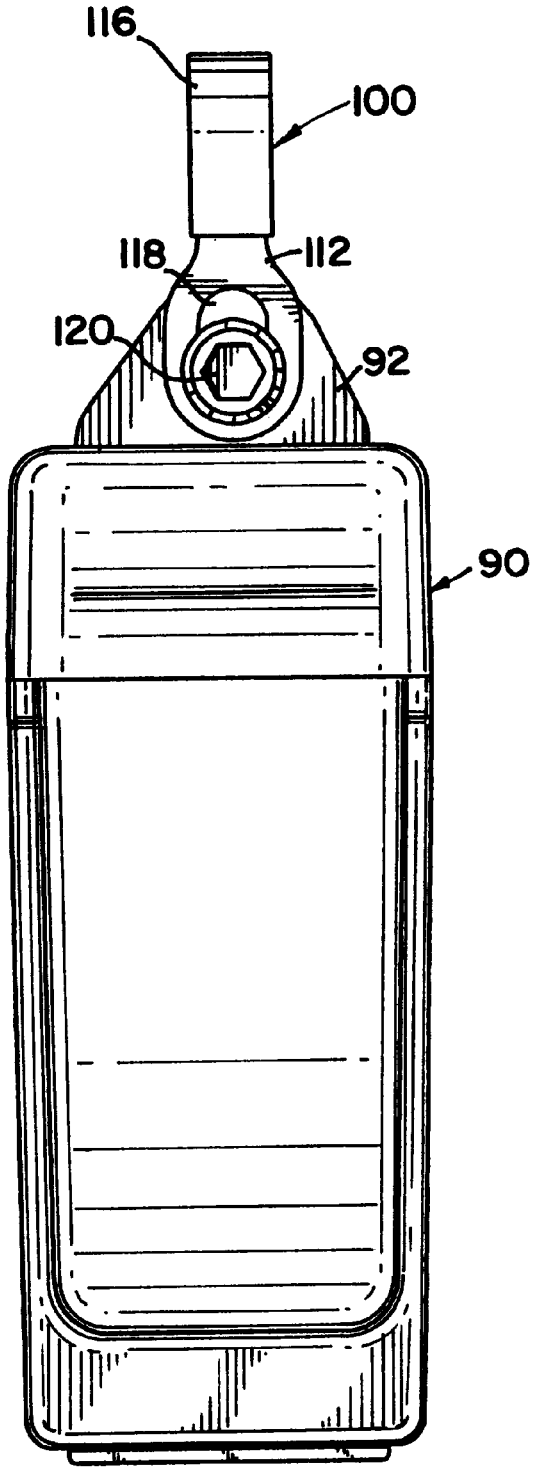
FIG. 2 is a side view of the personal safety apparatus and connector of FIG. 1.
Figure 3:
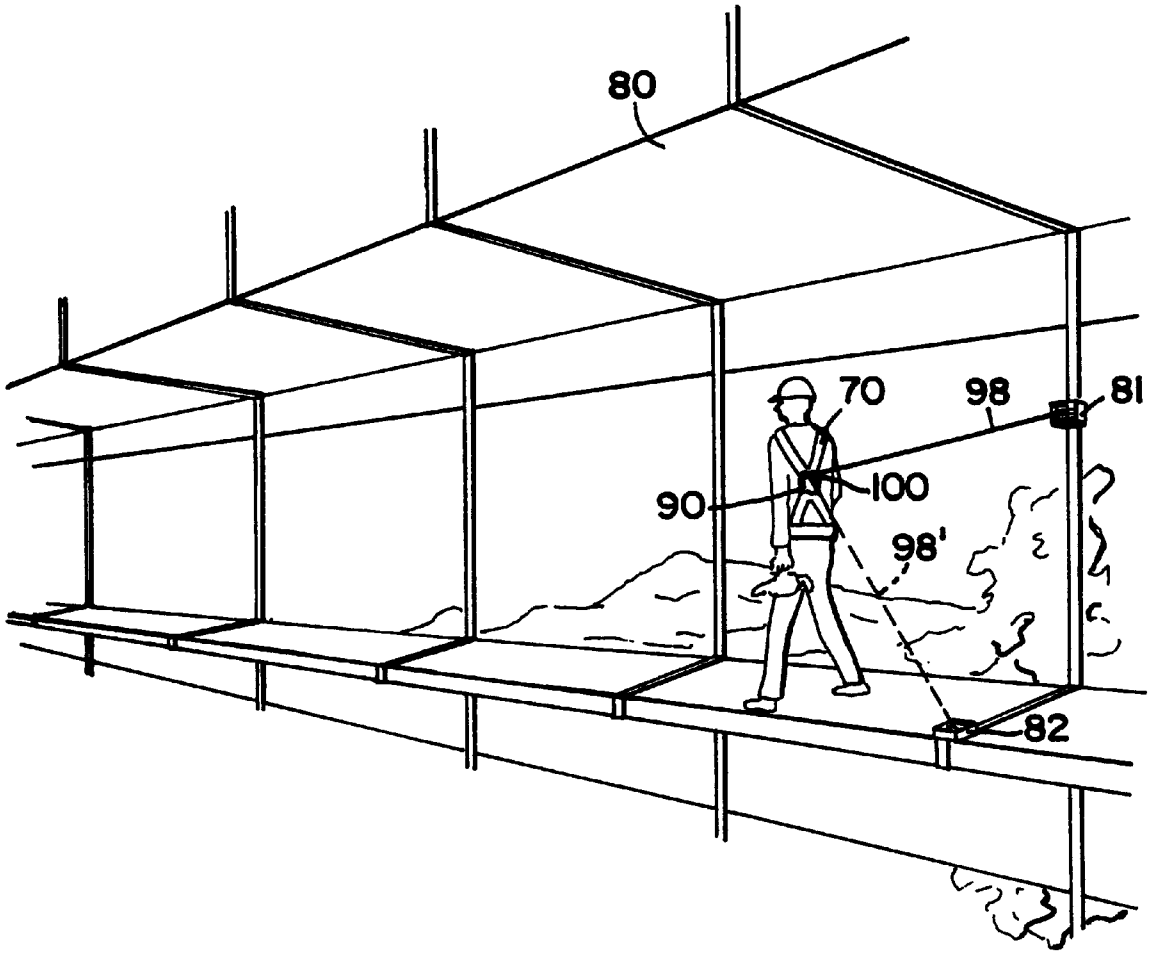
FIG. 3 is a perspective view of the personal safety apparatus and connector of FIG. 1 interconnected in series between a support structure and a body harness.
Figure 4:
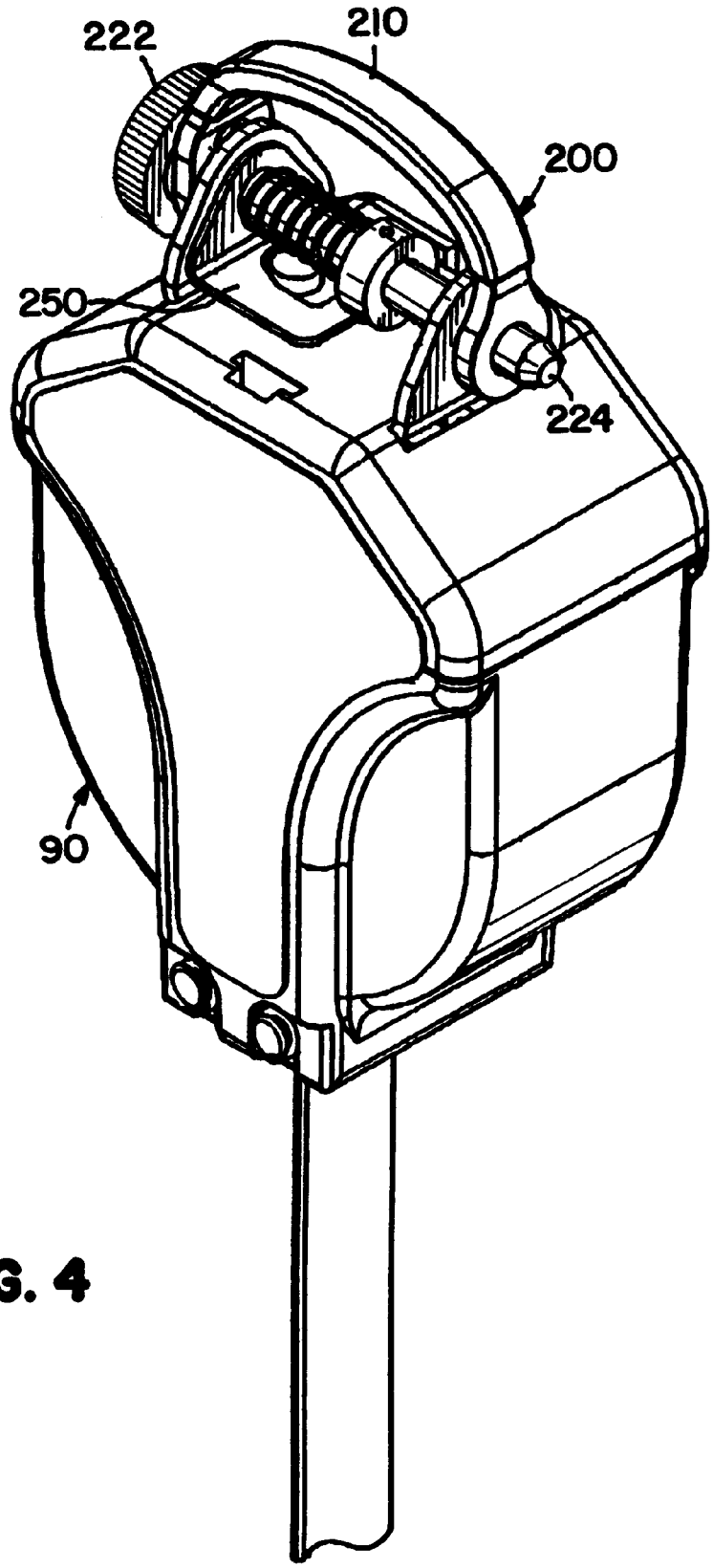
FIG. 4 is a perspective view of the personal safety apparatus of FIG. 1 provided with a second connector constructed according to the principles of the present invention.
Figure 5:
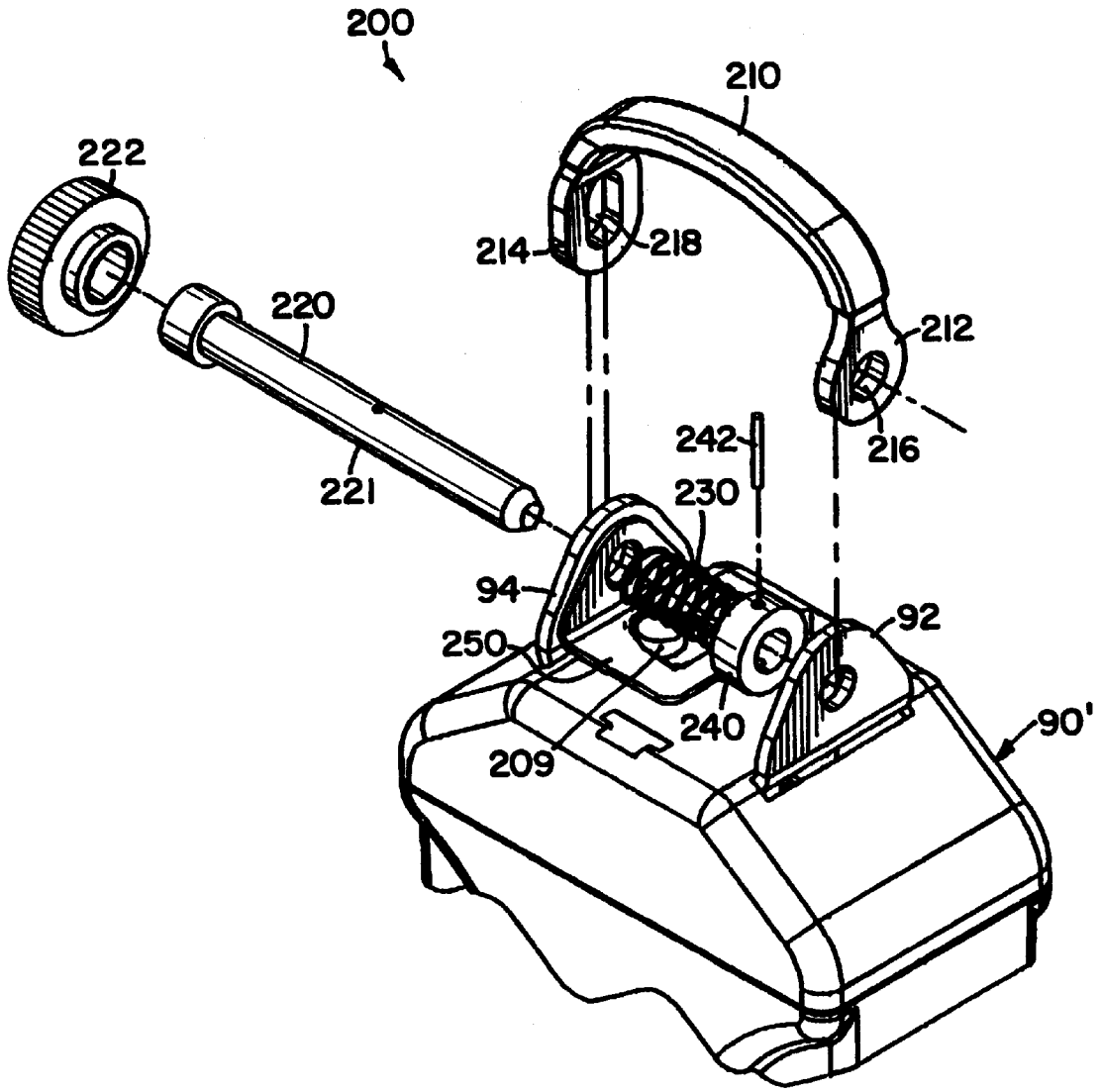
FIG. 5 is an exploded perspective view of the personal safety device and connector of FIG. 4.

A first connector constructed according to the principles of the present invention is designated as 100 in FIGS. 1–3. The connector 100 includes a structural member 110 and a bolt 120 which cooperate to releasably connect a personal safety device 90 (with safety line 98) in series between a support structure 80 and a person's harness 70, as shown in FIG. 3. Exemplary prior art safety devices are disclosed in U.S. Pat. No. 5,351,906 to Feathers and U.S. Pat. No. 4,877,110 to Wolner, which are incorporated herein by reference.

The structural member 110 is preferably made of steel and may be described as a U-shaped member having an intermediate base portion, and opposite ends or legs 112 and 114 which extend from opposite ends of the base portion and parallel to one another. The base portion is covered by a protective sleeve 116 which is preferably made of plastic. A slot 118 is provided in the first end 112 of the member 110 (FIG. 2), and a threaded hole is provided in the second end 114 of the member 110.

The bolt 120 is preferably made of steel and has a shaft 121 which extends perpendicular to the ends 112 and 114 of the member 110. A first end 122 of the bolt 120 is provided with a head having a diameter which is greater than the diameter of the shaft 121. A second, opposite end 124 of the bolt 120 is provided with external helical threads which mate with the threaded hole in the second end 114 of the member 110.

The second end 124 of the bolt 120 is inserted through the slot 118, then through a hole in a first flange or tab 92 on the device 90, and then through a helical coil spring 130. A stop 140 is then rigidly secured to an intermediate portion of the shaft 121 on the bolt 120, in such a manner that the spring 130 is compressed between the stop 140 and the flange 92. The stop 140 has a relatively larger diameter than the shaft 121 of the bolt 120 and may be described as a shoulder on the bolt 120. The second end 124 may then be selectively inserted through a hole in a second flange or tab 94 on the device 90, and threaded through the hole in the second end 114 of the member 110.

The threads on the second end 124 of the bolt 120 and inside the hole in the second end 114 of the member 110 provide a means for selectively connecting the second end 124 of the bolt 120 to the second end 114 of the member 110. The spring 130 cooperates with the stop 140 to provide a means for biasing the second end 124 of the bolt 120 to remain connected to the second end 114 of the member 110. The stop 140, the first end 112 of the member 110, and the head of the bolt 120 cooperate to provide a means for securing the connector 100 to the first flange 92. The slot 118 in the first end 112 of the member 110 provides a means for pivoting the connector 100 relative to the first flange 92 when the second end 122 of the bolt is free of the second flange 94.

Those skilled in the art will recognize that alternative arrangements may be used to perform one or more of the aforementioned functions. For example, the first end 112 of the member 110 may be hinged relative to the remainder thereof to facilitate pivoting of the connector 100 relative to the first flange 92. Also, the bias of the spring 130 may operate (in the absence of threads) to facilitate connection of the second end 124 of the bolt 120 to the second end 114 of the member 110. On one alternative embodiment, for example, the second end 124 of the bolt 120 is devoid of threads and has an outside diameter which is less than the inside diameter of the threaded hole. Thus, even when the shaft 121 is not threaded into the threaded hole, the spring 130 biases the second end 124 to remain in the hole. Another option is to use a cotter pin or other latching device to further discourage undesired removal of the bolt end 124 from the member end 114.

Those skilled in the art will also recognize that the connectors of the present invention may be used at various locations in various personal safety systems. For example, FIG. 3 shows the connector 100 attached to the personal safety device 90 and releasably connected to a harness 70 in the same manner as and/or by means of a D-ring, for example. A safety line 98 (or 98') emanates from the device 90 and is releasably connected to a support structure 80. This arrangement is advantageous because it facilitates convenient locking into and out of discrete anchorages (81 and 82, for example) on the support structure. However, the connectors of the present invention may be used in other arrangements according to the needs dictated by a particular situation and/or the preferences of the persons involved.

Another connector constructed according to the principles of the present invention is designated as 200 in FIGS. 4–8. The connector 200 similarly includes a structural member 210 and a bolt 220 which cooperate to releasably connect a personal safety device 90' in series between a support structure and a person's harness (in a manner similar to the first embodiment 100). The device 90' is identical to the device 90 except for a nub 209 which projects from the device 90' proximate the tab 94.

The structural member 210 is identical to the structural member 110 except that the hole 216 is not provided with internal threads. The bolt 220 is preferably made of steel and has a shaft 221 which extends perpendicular to the ends 212 and 214 of the member 210. A first end of the bolt 220 is provided with a head having a diameter which is greater than the diameter of the shaft 221. A knob 222 affixed to the first end of the bolt 220. A second, opposite end 224 of the bolt 120 is tapered and sized for insertion through the openings 216 and 218 in the respective ends 212 and 214 of the member 210.

During assembly of the connector 200, the second end 224 of the bolt 220 is inserted through the slot 218 in the first end 214 of the member 210, then through a hole in a first flange or tab 94 on the device 90', then through a hole in a lever 250, then through a helical coil spring 230, then through a stop 240, and finally through a hole in a second flange or tab 92 on the device 90'. The stop 240 is then rigidly secured to an intermediate portion of the shaft 221 (by pin 242, for example), such that the spring 230 is compressed between the stop 240 and the flange 94, and the second end 224 of the bolt 220 cannot be removed from the hole in the tab 92. The stop 240 has a relatively larger diameter than the shaft 221 of the bolt 220 and may be described as a shoulder on the bolt 220. The spring 230 bears against the stop 240 and thereby urges the second end 224 of the bolt 220 through the hole 216 in the second end 212 of the member 210.

The lever 250 may be described generally as L-shaped. A first segment 254 extends generally transverse to the bolt 220, and is disposed on the shaft 221 and captured between the stop 240 and the first tab 94 on the base 90'. A second segment 255 extends generally parallel to the bolt 220 and pivots into and out of engaging positions relative to the stop 240 on the bolt 220. The second segment 255 and the first segment 254 define an acute angle of approximately eighty degrees therebetween. The nub 209 on the device 90' projects into the rounded end of a tombstone-shaped opening in the second portion 255.

Figure 6:
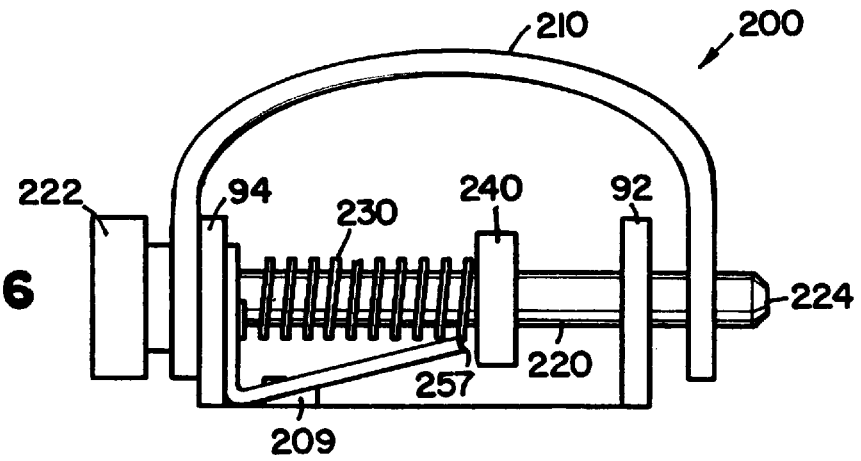
FIG. 6 is a front view of the connector of FIG. 4 in a closed position.

FIG. 6 shows the connector 200 in a stable, closed loop configuration, wherein the second end 224 of the bolt 220 extends through the hole 216 in the second end 212 of the member 210. The spring 230 biases both the bolt 220 and the lever 250 to remain in their respective positions shown in FIG. 6. The end 257 of the second segment 255 of the lever 250 is disposed within the path of the stop 240 and thereby prevents the bolt 220 from moving against the bias of the spring 230.

Figure 7:
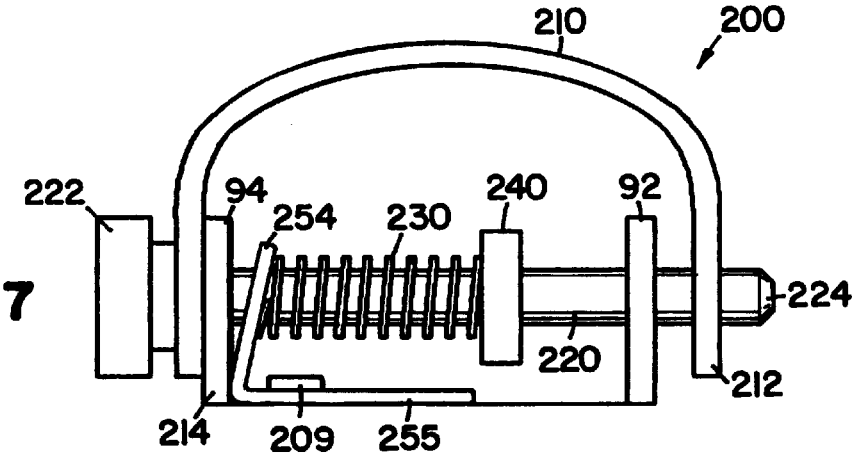
FIG. 7 is a front view of the connector of FIG. 4 in an intermediate position.

FIG. 7 shows the connector 200 in an intermediate and unstable configuration, wherein the second segment 255 of the lever 250 has been pivoted toward the device 90', thereby providing clearance for the bolt 220 to be moved against the bias of the spring 230.

Figure 8:
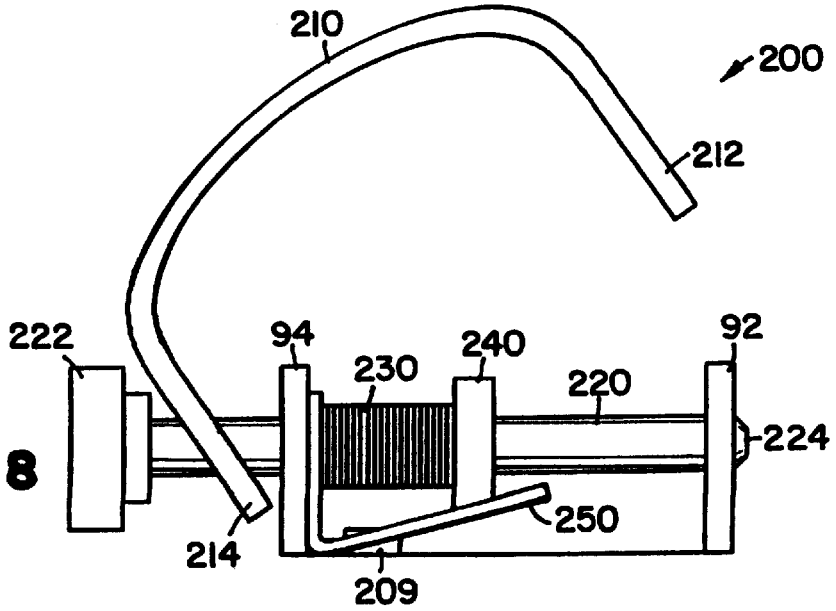
FIG. 8 is a front view of the connector of FIG. 4 in an open position.

FIG. 8 shows the connector 200 in a stable, open loop configuration, wherein the second end 212 of the member 210 is free of the bolt 220, and the bolt 220 is held open (and the spring 230 held more fully compressed) by the lever 250. In this regard, the stop 240 is disposed inside the tombstone-shaped opening in the second segment 255 and bears against the squared end of same. In this configuration, the second end 212 is available for insertion through an appropriate anchor on a building, harness, or other desired article. The bolt 220 may be released simply by moving the second segment 255 of the lever toward the device 90' (preferably with the second end 212 of the member 210 aligned with the tab 92.

The spring 230 and the stop 240 cooperate to provide a means for biasing the second end 224 of the bolt 220 to remain within the second end 212 of the member 210. The lever 250 cooperates with the spring 230 and the stop 240 to provide a means for selectively preventing removal of the second end 224 of the bolt 220 from the second end 212 of the member 210. The lever 250 alternatively cooperates with the spring 230 and the stop 240 to provide a means for selectively holding the bolt 220 in a retracted position. The stop 240, the first end 214 of the member 210, and the head 222 of the bolt 220 cooperate to provide a means for securing the connector 200 to the first flange 94. The slot 218 in the first end 214 of the member 210 provides a means for pivoting the connector 200 relative to the first flange 94 when the second end 224 of the bolt 220 is free of the second flange 92.

Another aspect of the present invention is the provision of built-in connectors or latching devices on personal safety equipment. In other words, a safety device constructed according to the principles of the present invention may be connected directly about a rod or safety line secured to a support structure, thereby eliminating the need for an interconnecting snap hook or other discrete component. In this regard, the connection between the stop 140 or 240 and the bolt 120 or 220 is intended to be permanent, and thus, the present invention may be seen to provide both the safety device and the connecting means as a unit.

Those skilled in the art will further recognize that the present invention may also be described in terms of a method. With reference to the first embodiment 100, for example, the present invention may be described in terms of a method of connecting a personal safety device in series between a person and a support structure. A bolt is inserted through a first end of a U-shaped member and through a first flange on the personal safety device. A coil spring is positioned on the bolt and retained in place by rigidly mounting a stop on an intermediate portion of the bolt. A second end of the U-shaped member is disposed about a suitable anchorage and/or inserted through a desired opening (such as a bracket on the support structure or a D-ring on a body harness), and then is aligned with a second flange on the personal safety device. A distal end of the bolt is then inserted through the second flange and biased to remain engaged with the second end of the U-shaped member.

Although the present invention has been described with reference to preferred embodiments and particular applications, this disclosure will enable those skilled in the art to recognize additional embodiments and/or applications which fall within the scope of the present invention. Accordingly, the scope of the present invention should be limited only to the extent of the following claims.

What is claimed is:

1. An apparatus, comprising:

a base having a first flange and a second flange;

a generally U-shaped structural member having a first end and a second end;

a bolt having a shaft, a relatively larger diameter head connected to a first end of the shaft, and a relatively larger diameter shoulder connected to an intermediate portion of the shaft, wherein both the first flange on the base and the first end of the structural member are disposed on the shaft and captured between the head and the shoulder;

a lever having a first portion which extends generally transverse to the bolt and is disposed on the shaft and captured between the shoulder and the first flange on the base, and a second portion which extends generally parallel to the bolt and includes an edge which extends generally transverse to the bolt;

a spring disposed on the shaft and compressed between the shoulder and the first portion of the lever, wherein absent any externally applied force, the spring biases an opposite, second end of the shaft into aligned holes extending through the second flange on the base and the second end of the structural member, thereby biasing the bolt and the structural member to remain in a closed loop configuration, and wherein the bolt is selectively movable against force exerted by the spring to a position wherein the second end of the shaft is free of the second end of the structural member, and the edge on the lever bears against the shoulder on the bolt to counteract the force exerted by the spring, thereby biasing the bolt and the structural member to remain in an open loop configuration until the lever is moved to release the shoulder and the spring urges the second end of shaft through the second end of the structural member.

2. The apparatus of claim 1, wherein the first portion of the lever and the second portion of the lever define an acute angle therebetween, and the shaft extends perpendicular to the first portion of the lever and the first flange on the base when in the closed loop configuration.

3. The apparatus of claim 2, wherein the shaft also extends perpendicular to the first portion of the lever and the first flange on the base when in the open loop configuration.

4. The apparatus of claim 2, wherein the second portion of the lever must be moved toward a parallel orientation relative to the bolt, in opposition to a bias force exerted by the spring, to provide clearance for movement of the shoulder toward the first flange to facilitate transformation from the closed configuration to the open configuration.

5. The apparatus of claim 2, wherein the edge on the second portion of the lever bounds an opening extending through the second portion of the lever.

6. The apparatus of claim 5, wherein a nub projects outward from the base and into the opening in the second portion of the lever.

7. The apparatus of claim 5, wherein the shoulder projects into the opening when in the open loop configuration.

8. The apparatus of claim 1, wherein the bolt extends perpendicular through the first flange and the second flange in each said configuration.

9. The apparatus of claim 1, wherein the second portion of the lever must be moved away from the bolt, in opposition to a bias force exerted by the spring, to provide clearance for movement of the shoulder toward the first flange to facilitate transformation from the closed configuration to the open configuration.

10. The apparatus of claim 1, wherein both the first flange and the second flange are disposed between the first end of the structural member and the second end of the structural member.

11. An apparatus, comprising:

a base having a first flange and a second flange;

a generally U-shaped structural member having a first end and a second end;

a bolt having a shaft, a relatively larger diameter head connected to a first end of the shaft, and a relatively larger diameter shoulder connected to an intermediate portion of the shaft, wherein both the first flange on the base and the first end of the structural member are movably mounted on the shaft between the head and the shoulder;

a first means, movably mounted on the shaft between the head and the shoulder, for biasing an opposite, second end of the shaft into aligned holes extending through the second flange on the base and the second end of the structural member, thereby defining a closed loop configuration; and a second means, movably mounted on the shaft between the head and the shoulder, for selectively preventing movement of the shaft in opposition to bias exerted by the first means.

12. The apparatus of claim 11, wherein the second means alternatively selectively resists bias exerted by the first means when the shaft is moved to an open loop configuration with the second end of the shaft free of the second end of the structural member.

13. The apparatus of claim 12, wherein the second means is a generally L-shaped lever having a first portion which is mounted on the shaft, and a second portion which engages the shoulder.

14. The apparatus of claim 13, wherein an exterior edge on the second portion of the lever overlies a trailing surface on the shoulder when the bolt occupies the closed loop configuration, and an opposite facing, interior edge on the second portion of the lever overlies an opposite facing, leading surface on the shoulder when the bolt occupies the open loop configuration.

15. The apparatus of claim 14, wherein the first means is a helical coil spring compressed between the shoulder and the first portion of the lever.

16. The apparatus of claim 13, wherein the first means is a helical coil spring compressed between the shoulder and the first portion of the lever.

17. The apparatus of claim 12, wherein the first means is a helical coil spring compressed between the shoulder and the second means.

18. The apparatus of claim 11, wherein the first means is a helical coil spring compressed between the shoulder and the second means.

19. The apparatus of claim 18, wherein the second means is a generally L-shaped lever having a first portion which is mounted on the shaft, and a second portion which engages the shoulder.

20. The apparatus of claim 19, wherein the first portion and the second portion define an acute angle therebetween, and the first portion is disposed between the spring and the first flange on the base.

* * * * *